United States Patent [19]

Wonnacott

[11] Patent Number: 4,860,944

[45] Date of Patent: Aug. 29, 1989

[54] CARTON AND BLANK THEREFOR

[75] Inventor: Roger J. Wonnacott, Launceston, United Kingdom

[73] Assignee: St. Regis Packaging Limited, Launceston, United Kingdom

[21] Appl. No.: 283,195

[22] Filed: Dec. 12, 1988

[51] Int. Cl.[4] ..... B65D 5/46

[52] U.S. Cl. ..... 229/52 B; 229/40; 229/52 BC; 229/199; 206/141; 206/427; 206/428

[58] Field of Search ..... 229/52 B, 40, 52 BC, 229/199; 206/428, 434, 427, 141

[56] References Cited

U.S. PATENT DOCUMENTS

| | | | |
|---|---|---|---|
| 2,359,298 | 10/1944 | Brogden | 229/52 BC |
| 2,662,684 | 12/1953 | Robins | 229/52 B |
| 2,723,027 | 11/1955 | Guyer | 229/52 B |
| 2,842,304 | 7/1958 | Ringler | 206/428 |
| 2,872,036 | 2/1959 | Forrer | 229/40 |
| 2,874,869 | 2/1959 | Hennessey | 229/40 |
| 2,955,739 | 10/1960 | Collura | 206/428 |
| 2,986,324 | 5/1961 | Anderson, Jr. | 229/52 B |
| 3,076,591 | 2/1963 | Nute et al. | 229/52 B |
| 3,094,268 | 6/1963 | Swanson et al. | 229/52 B |
| 3,112,856 | 12/1963 | MacIntosh et al. | 229/52 B |
| 3,356,279 | 12/1967 | Root | 206/427 |
| 3,371,846 | 3/1968 | Detzel | 229/40 |
| 3,794,239 | 2/1974 | Bonczyk | 229/52 B |
| 4,222,485 | 9/1980 | Focke | 206/141 |
| 4,301,922 | 11/1981 | Hamelin et al. | 206/428 |
| 4,418,864 | 12/1983 | Nielson | 229/52 B |
| 4,470,503 | 9/1984 | Stone | 206/428 |
| 4,498,619 | 2/1985 | Roccaforte | 229/DIG. 9 |
| 4,546,914 | 10/1985 | Roccaforte | 229/52 B |
| 4,567,070 | 1/1986 | Karass | 428/35 |
| 4,747,534 | 5/1988 | Marie | 229/40 |
| 4,817,866 | 4/1989 | Wonnacott | 206/427 |

FOREIGN PATENT DOCUMENTS

| | | | |
|---|---|---|---|
| 0697701 | 11/1964 | Canada | 229/52 B |
| 0712905 | 7/1965 | Canada | 229/52 B |
| 2756374 | 6/1979 | European Pat. Off. | 229/40 |
| 2052618 | 1/1980 | Fed. Rep. of Germany | 206/429 |
| 1438035 | 6/1965 | France | 229/52 B |
| 2508415 | 12/1982 | France | 206/427 |
| WO85/02385 | 6/1985 | PCT Int'l Appl. | 206/428 |
| 1240549 | 7/1971 | United Kingdom | 229/52 B |

*Primary Examiner*—Stephen Marcus
*Assistant Examiner*—Kathryn M. Stemann
*Attorney, Agent, or Firm*—Dann, Dorfman, Herrell & Skillman

[57] ABSTRACT

A carton for an even number of rows of cans has a carrying handle formed from strip-reinforced carton material by means of cuts flanking the reinforcing strip and separating the handle from the rest of the carton, said strip being off-set from the median plane of the carton where it can surround one of said rows of cans.

9 Claims, 2 Drawing Sheets

CARTON AND BLANK THEREFOR

TECHNICAL FIELD

This invention relates to a carrying carbon specifically designed to accommodate an even number of rows of articles (e.g. cylindrical cans). It is known (e.g. from U.S. Pat. No. 4,567,070 (Karass)) to provide a carrying carton with a handle constructed from a reinforced length of carton material and this invention concerns an improved location for the handle for such a carton. The invention also extends to a blank from which such a carton can be erected.

SUMMARY OF THE INVENTION

According to one aspect of the invention there is provided a carton formed from stiff but foldable carton material which contains an even number of rows of articles which has a median plane passing mid-way between said even number of rows and which incorporates a length of flexible reinforcing material extending in a plane parallel to said median plane, a handle strip being created in the carton material by means of a pair of cuts extending on opposite sides of the reinforcing material, wherein the length of reinforcing material is off-set from the median plane of the carton whereby the said length of reinforcing material surrounds the articles in one of said rows.

Suitably there are four rows and the length of reinforcing material surrounds the second row.

Preferably each cut defining the handle strip is a serrated cut of curvilinear form. Suitably the serrations have a pitch of the order of 1/10th inch.

Providing a handle defined by at least one serrated cut means that when the handle is bent out from the plane of the carton to allow the latter to be carried the carton material on opposite sides of each cut is displaced from one another so that there is a frictional engagement between the two serrated surfaces which confront along the boundary of the handle, this frictional engagement tending to hold the handle in its bent-out condition.

Suitably the reinforcement is a length of fibrous tape and conveniently, where the carbon material is double faced corrugated paper board (e.g. a corrugated web sandwiched between two plane facing webs) the tape is trapped between the corrugated web and one of the facing webs in the manufacture of the board.

According to a further aspect of the invention a blank for erection into a carrying carton of rectangular cross-section having a reinforced handle, which blank is designed to enclose four rows of cylindrical cans and comprises panels defining four carton walls delimited one from the other by fold lines on the blank and a handle region forming part of at least one wall which handle region incorporates a length of reinforcing material, the handle region being defined by a spaced-apart pair of serrated cuts on opposite sides of said length of reinforcing material where it crosses said at least one wall, said length extending across all four walls at a location where it will surround a central region of the cans in one of the two central rows of cans in the erected carton.

BRIEF DESCRIPTION OF THE DRAWINGS

One embodiment of carton and blank in accordance with the invention will now be described, by way of example, with reference to the accompanying drawings, in which.

DESCRIPTION OF PREFERRED EMBODIMENT

Figure 1:
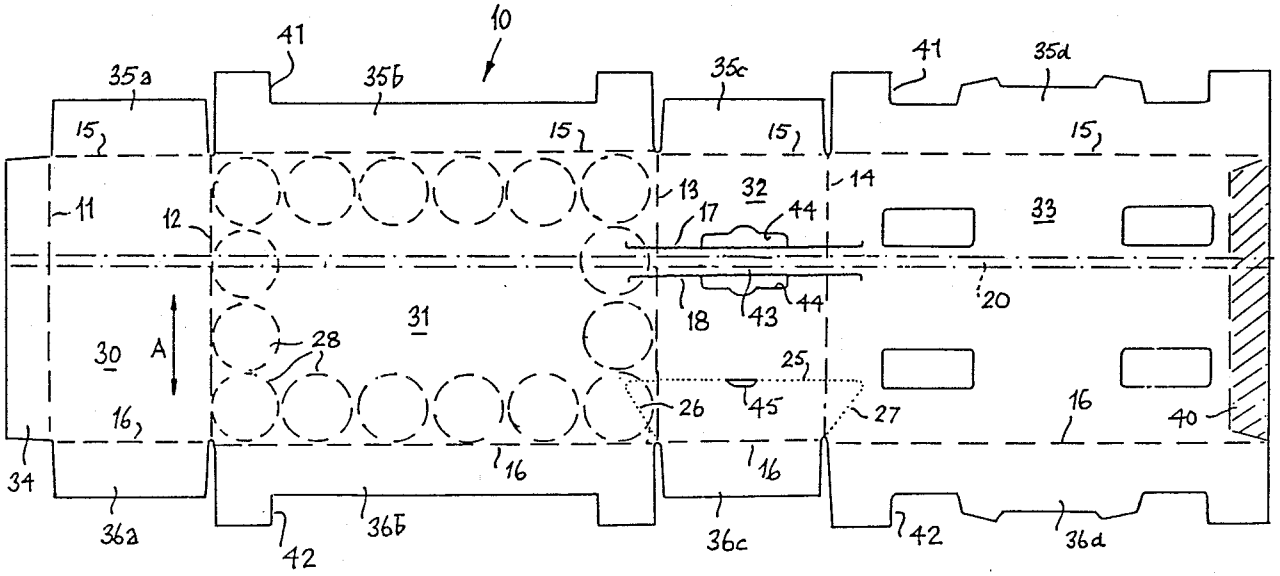
FIG. 1 is a plan of a blank for erection into a carrying carton.
Figure 3:
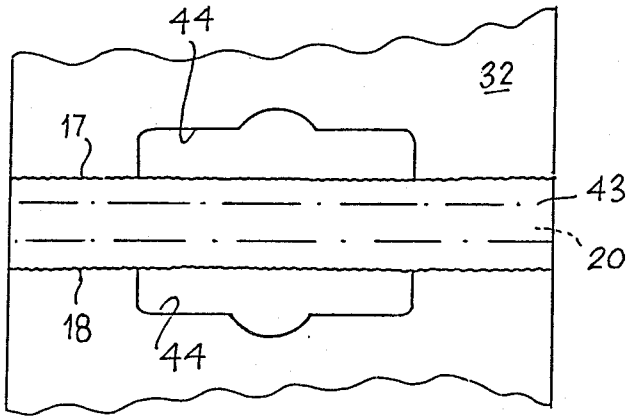
FIGS. 3 and 4 are enlarged views of the handle prior to and after being bent from the carton to permit carrying of the carton and its contents.
Figure 4:
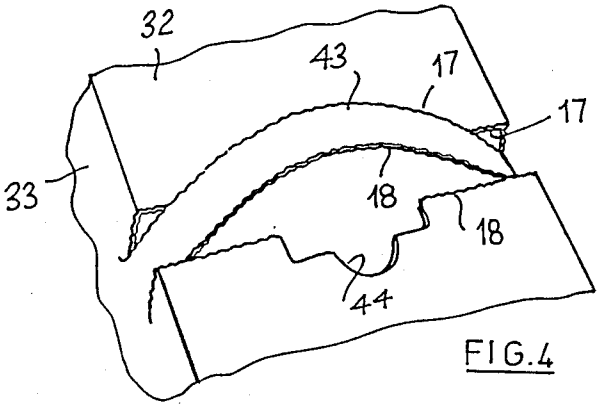

The blank 10 shown in FIG. 1 comprises a sheet of double faced corrugated paper board with the direction of the flutes in the central web of the three-ply material extending in the directions of the arrow A. The drawing is from the inside of the blank so that each of the fold lines indicated by dashed lines in FIG. 1 fold upwardly from the plane of the paper when the blank is erected to form the carton shown in FIG. 2.

The fold lines 11, 12 delimit a first end wall 30, fold lines 12 and 13 delimit a first side wall 31, fold lines 13 and 14 delimit a second end wall 32 and fold line 14 marks one end of a second side wall 33. An attachment flap 34 delimited by fold line 11 is designed to be secured to the shaded area 40 to form the blank into a hollow tube of rectangular cross-section.

Top flaps for the erected carton are formed from panels 35*a*, 35*b*, 35*c* and 35*d* delimited by fold lines 15 and bottom flaps are formed from panels 36*a*, 36*b*, 36*c* and 36*d* delimited by fold lines 16. The panels 35*b*, 35*d*, 36*b* and 36*d* are provided with cut-outs 41 and 42 which give rise to upper and lower windows in the erected carton.

Figure 2:
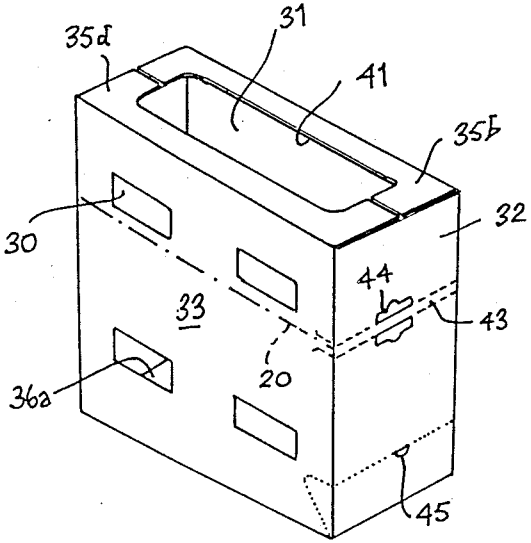
FIG. 2 is a view of the carton erected from the blank of FIG. 1.

To enable the filled carton shown in FIG. 2 to be carried easily it is provided with a carrying handle 43 formed in the end wall 32.

The handle 43 is defined between a pair of cuts 17 and 18 and includes a length of reinforcing tape 20 incorporated in the board material (e.g. heat-sensitive adhesive-coated fibrous tape incorporated between webs of the board on the corrugator).

The cuts 17 and 18 are of serrated form (curvilinear as shown but they could be saw toothed, for example) and extend across panel 32 and encroach slightly on adjacent panels 31 and 32 so that as the handle 43 is bent out of the plane of the panel 32, the strip between the cuts 17 and 18 becomes frictionally engaged in the serrations of the panel 32 retaining its curved form when the carrying load is removed (possibly following clearance for intrusion of the handle into the contents space of the carton by removal of part of the packaged contents).

Further advantages of the use of serrations on the cuts 17 and 18 are that they more securely hold the handle 43 in the plane of the panel 32 prior to first use for carrying the carton and use of curvilinear serrations reduces the risk of the cuts 17 and 18 damaging the hand of the person carrying the filled carton.

The carton shown in FIG. 2 is designed to accommodate 24 cans (e.g. of beverage) in four rows of six cans each. The location of the ends of some of these cans are shown at 28 on side wall 31 in FIG. 1. The location of the reinforcing tape 20 completely surrounds one of the rows (in the illustrated case the third row up from the bottom flaps) so that the handle is not located centrally of the end panel 32 i.e. it is off-set from the median plane between the rows of cans. This off-set location of the handle 43 has a minor disadvantage in not containing the median plane through which the centre of gravity of the fully filled carton acts but has a significant advantage in being located around a row of cans rather than in part between a row of cans so that excessive tension on the tape 20 cannot cause it to cut through the board material and partially separate one row from another.

Curvilinear serrations (e.g. of sinusoidal form) are preferred for the handle-defining cuts and serrations of a pitch of the order of ten per linear inch along each cut perform well. The central region of each handle cut 17 and 18 traverses cut outs 44 facilitating finger access to the handle 43.

The end wall panel 32 and adjacent panels 31 and 33 also includes lines of weakness 25, 26 adn 27 which demark an openable flap that, when bent away from the plane of the panel 32, permits one-by-one dispensing of cans from the lowermost row in the carton. An opening 45 in the line 25 provides a finger grip to prise open the flap defined by the lines 25–27.

The particular shape of the opening 41 in panel 35*d* and 42 in panel 36d traces part of a manufacturers logo and has not been reproduced in the opening 41 shown in FIG. 2.

What is claimed is:

1. A carton formed from stiff but foldable carton material which contains an even number of rows of articles which has a median plane passing mid-way between said even number of rows and which incorporates a length of flexible reinforcing mateiral extending in a plane parallel to said median plane, a handle strip being created in the carton material by means of a pair of cuts extending on opposite sides of the reinforcing material, wherein the length of reinforcing material is off-set from the median plane of the carton whereby the said length of reinforcing material surrounds the articles in one of said rows.

2. A carton as claimed in claim 1, in which there are four rows and the length of reinforcing material surrounds the second row.

3. A carton as claimed in claim 1, in which each cut defining the handle strip is a serrated cut of curvilinear form.

4. A carton as claimed in claim 2, in which each cut defining the handle strip is a serrated cut of curvilinear form.

5. A carton as claimed in claim 3, in which the serrations have a pitch of the order of 10 to the inch.

6. A carton as claimed in claim 4, in which the serrations have a pitch of the order of 10 to the inch.

7. A carton as claimed in claim 1, in which the carton material is double faced corrugated paper board formed from a corrugated web sandwiched between two plane facing webs, a length of fibrous tape being trapped between the corrugated web and one of the facing webs in the manufacture of the board and positioned to be off-set from the median plane between said rows when the carton material surrounds the articles.

8. A carton as claimed in claim 7, containing four rows of cylindrical cans, in which the tape completely surrounds one of the two central rows of cans in the carton.

9. A blank for erection into a carrying carton of rectangular cross-section having a reinforcing handle, which blank is designed to enclose four rows of cylindrical cans and comprises panels defining four carton walls delimited one from the other by fold lines on the blank and a handle region forming part of at least one wall which handle region incorporates a length of reinforcing material, the handle region being defined by a spaced-apart pair of serrated cuts on opposite sides of said length of reinforcing material said length extending across all four walls at a location where it will surround a central region of the cans in one of the two central rows of cans in the erected carton.

* * * * *

UNITED STATES PATENT AND TRADEMARK OFFICE

CERTIFICATE OF CORRECTION

PATENT NO. : 4,860,944

DATED : August 29, 1989

INVENTOR(S) : Roger J. Wonnacott

It is certified that error appears in the above-identified patent and that said Letters Patent is hereby corrected as shown below:

Col. 1, line 5, "carbon" should be --carton--;

Col. 1, line 45, "carbon" should be --carton--;

Col. 2, line 45, "32" should be --33--;

Col. 3, line 14, "adn" should be --and--.

Signed and Sealed this

Seventeenth Day of July, 1990

*Attest:*

*Attesting Officer*

HARRY F. MANBECK, JR.

*Commissioner of Patents and Trademarks*